US006997130B1

(12) United States Patent
Fretwell

(10) Patent No.: US 6,997,130 B1
(45) Date of Patent: Feb. 14, 2006

(54) MOTORBOAT ENGINE COVER

(76) Inventor: Paul Fretwell, 65 Myrtle Dr., Oroville, CA (US) 95966

( * ) Notice: Subject to any disclaimer, the term of this patent is extended or adjusted under 35 U.S.C. 154(b) by 0 days.

(21) Appl. No.: 10/981,012

(22) Filed: Nov. 3, 2004

(51) Int. Cl.
*B63J 2/00* (2006.01)

(52) U.S. Cl. ..... 114/211; 440/88 A

(58) Field of Classification Search ..... 123/198 E; 454/78; 440/88 A; 114/211
See application file for complete search history.

(56) References Cited

U.S. PATENT DOCUMENTS

| | | | | |
|---|---|---|---|---|
| 3,620,184 | A * | 11/1971 | Thousand | 440/12.66 |
| 4,781,141 | A | 11/1988 | Webb et al. | |
| 5,025,745 | A | 6/1991 | Wine | |
| D409,555 | S | 5/1999 | Lapointe et al. | |
| 6,085,713 | A | 7/2000 | Wada | |
| 6,167,976 | B1 * | 1/2001 | O'Neill et al. | 180/69.2 |
| 6,240,885 | B1 | 6/2001 | Hanson | |
| 6,343,964 | B1 | 2/2002 | Mardikian | |
| 6,413,131 | B1 | 7/2002 | Phillips et al. | |
| 6,551,155 | B1 | 4/2003 | Lecours et al. | |
| 6,647,962 | B1 | 11/2003 | Kuroda | |
| D485,798 | S | 1/2004 | Kalhok et al. | |
| 6,699,083 | B1 | 3/2004 | Rinzaki et al. | |
| 6,715,454 | B1 | 4/2004 | Yonezawa | |
| 6,766,780 | B1 | 7/2004 | Ikuma et al. | |
| 6,790,111 | B1 | 9/2004 | Yomo et al. | |
| 2002/0111085 | A1 | 8/2002 | Rinzaki et al. | |
| 2003/0183150 | A1 | 10/2003 | Eck et al. | |
| 2004/0018785 | A1 | 1/2004 | Yasuda et al. | |

* cited by examiner

*Primary Examiner*—Stephen Avila
(74) *Attorney, Agent, or Firm*—Buchanan Ingersoll, LLP

(57) ABSTRACT

A motorboat engine cover made from a metal panel having a plurality of air passages cut therethrough, wherein the air passages are formed such that the panel has no air pockets on its underside, and wherein the metal panel is configured to be mounted horizontally above a motorboat engine such that substantially unrestricted airflow occurs between the metal panel and the motorboat engine.

18 Claims, 7 Drawing Sheets

MOTORBOAT ENGINE COVER

TECHNICAL FIELD

The present invention relates to engine covers for motorboats.

BACKGROUND OF THE INVENTION

For safety reasons, inboard motorboat engines are equipped with engine covers to protect persons in the boat from the heat of the engine. Such engine covers are typically made from injection molded plastic, and are supplied by the engine manufacturer together with the engine itself.

Such standard plastic engine covers suffer from numerous disadvantages. First, plastic is not a rigid material. Therefore, such engine covers are typically injection molded with a plurality of baffles/interior walls on their underside to give the engine cover sufficient rigidity.

An example of a standard plastic injection molded cover for a Mercury™ 496 MAG/MAG HO motor is show in FIGS. 1 and 2. As can be seen in the top perspective view of FIG. 1, cover 10 has air holes 12 passing therethrough.

As can be seen in the bottom perspective view of FIG. 2, holes 12 are surrounded by walls 14 therearound. Walls 14 add strength to cover 10. Unfortunately, walls 14 also act as air baffles, trapping pockets of heated air under cover 10. As a result, walls 14 interfere with the free flow of air around the top of the engine, thus impeding engine cooling.

In addition, cover 10 also has a single continuous side wall 16 passing therearound. Side wall 16 also adds strength to cover 10, especially at the edges of cover 10. However, side wall 16 also acts to trap a pocket of heated air under cover 10.

A further disadvantage of plastic cover 10 is that it does not conduct heat away from the engine, nor does it dissipate heat from the engine.

SUMMARY AND ADVANTAGES OF THE INVENTION

The present invention provides a motorboat engine cover that is formed from a metal panel having a plurality of air passages cut therethrough. These air passages are formed such that the panel has no air pockets on its underside. Preferably, the metal panel has a thickness from 0.078 to 0.250 inches, and is configured to be mounted horizontally above a motorboat engine such that substantially unrestricted airflow occurs between the metal panel and the motorboat engine. This advantageously permits substantially improved cooling of the engine (especially as compared to the injection molded plastic engine cover of FIGS. 1 and 2 in which walls 14 and 16 trap air, and hinder air flow under cover 10). Moreover, the generally planar shape of the present engine cover results in optimal airflow both over and under the engine cover. Such airflow cools the engine cover, which in turn cools the engine. Being thin, the present cover also readily dissipates the heat received from the engine.

The metal panel engine cover of the present invention may be formed from aluminum, and/or stainless steel, but is not so limited. An advantage of being formed from such materials is that the present engine cover effectively dissipates heat away from the engine. In addition, such metals conduct heat away from the engine, acting as a "heat sink" to keep the engine cool.

In various embodiments, the air passages in the engine cover are cut in a repeating pattern along the length of the metal panel. Such repeating pattern may include any number of different artistic designs. Exemplary artistic designs are described herein. Such artistic designs are advantageous in that they provide a visually attractive embodiment for the present invention. Moreover, a variety of such designs are advantageous in that different customers can choose between different artistic designs.

In various embodiments, the air passages through the metal engine cover comprise from 20 to 40 percent of the total area of the metal panel. Having air passages comprise from 20 to 40 percent of the total area of the metal panel is particularly advantageous in that such air passages permit heated air (from the engine) to escape upwardly therethrough. Thus, the present engine cover does not trap heated air thereunder. Rather, the present engine cover promotes engine cooling.

The air passages through the present engine cover both: (1) permit heated air to rise therethrough directly from the engine; and (2) permit air flow both up and down through the metal panel as air passes horizontally thereacross.

In accordance with the present invention, having the air passages comprise from 20 to 40 percent of the total area of the metal panel provides an optimal mix of: (1) sufficient strength of the metal panel, (2) sufficient air passage (i.e.: cooling) through the metal panel, and (3) sufficient aperture size so as to able to design an artistically shaped design by way of the cut out sections through the metal panel. Thus, the present engine cover provides an advantageous balance of strength, airflow and heat dissipation properties.

In various embodiments, opposite side edges of the metal panel are bent downwardly, and the vertical distance between the top of the metal panel and the bottom of the downwardly bent edges is from 1.50 to 1.75 inches.

In one commercial application of the present invention, the motorboat engine cover is specifically dimensioned to be positioned on top of a Mercury™ 496 MAG/MAG HO motorboat engine. It is to be understood, however, that the present invention is not so limited. For example, the present metal panel engine cover may alternately be dimensioned to be used with other motorboat engines, as desired.

The present invention may also include three metal spacers configured to connect the motorboat engine cover to the motorboat engine. The three metal spacers may be configured to position the motorboat engine cover between 2.0 to 2.5 inches above the motorboat engine. The three metal spacers may be formed from aluminum, and/or stainless steel, but are not so limited. In various embodiments, the metal spacers are dimensioned small enough such that they do not interfere with air flow between the motorboat engine cover and the motorboat engine. A particular advantage of having the spacers be made of metal is that they conduct heat from the engine directly into the metal engine cover.

DETAILED DESCRIPTION OF THE DRAWINGS

Figure 1:
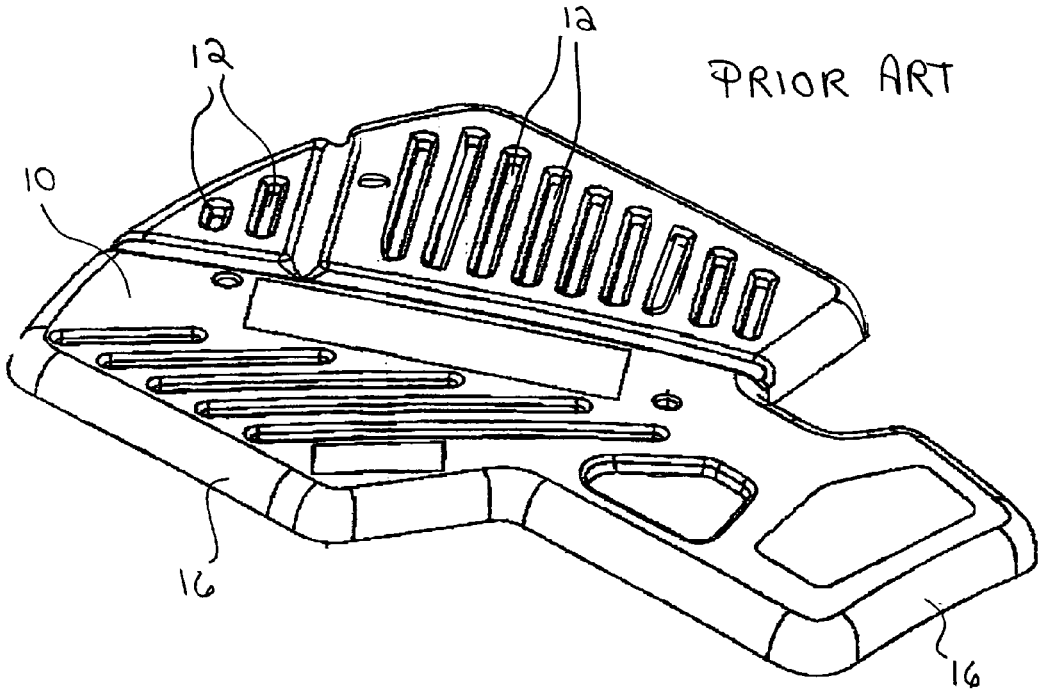
FIG. 1 is a top perspective view of a standard Mercury™ 496 MAG/MAG HO motorboat engine cover.
Figure 2:
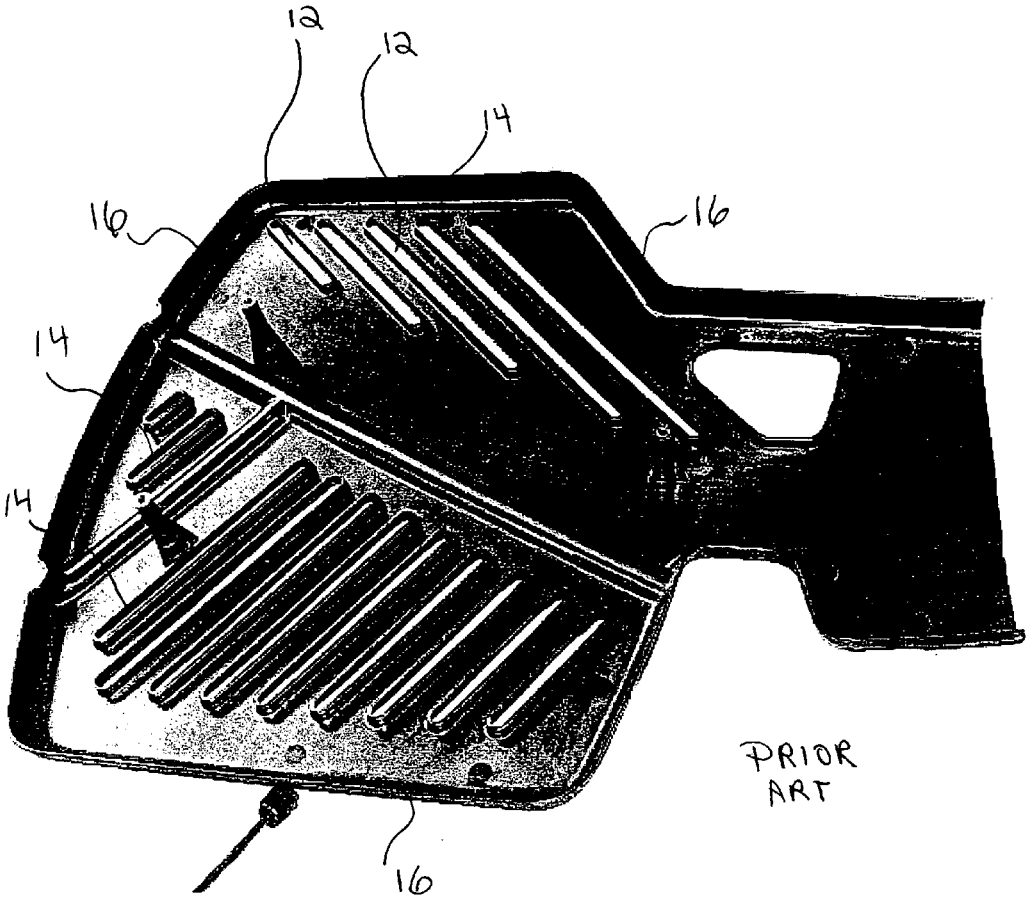
FIG. 2 is a bottom perspective view of the Mercury™ 496 MAG/MAG HO engine cover of FIG. 1.

FIGS. 1 and 2 show respective top and bottom view of a standard plastic injection molded Mercury™ 496 MAG/MAG HO motorboat engine cover 10. Cover 10 has air passages 12 therethrough. Each air passage 12 is surrounded by a wall 14. In addition, a side wall 16 wraps around the perimeter of cover 10.

FIGS. 3A to 5 show various embodiments of the present invention.

FIGS. 3A to 3D show various embodiments of the present invention, with different artistically cut air passages therethrough.

Figure 3A:
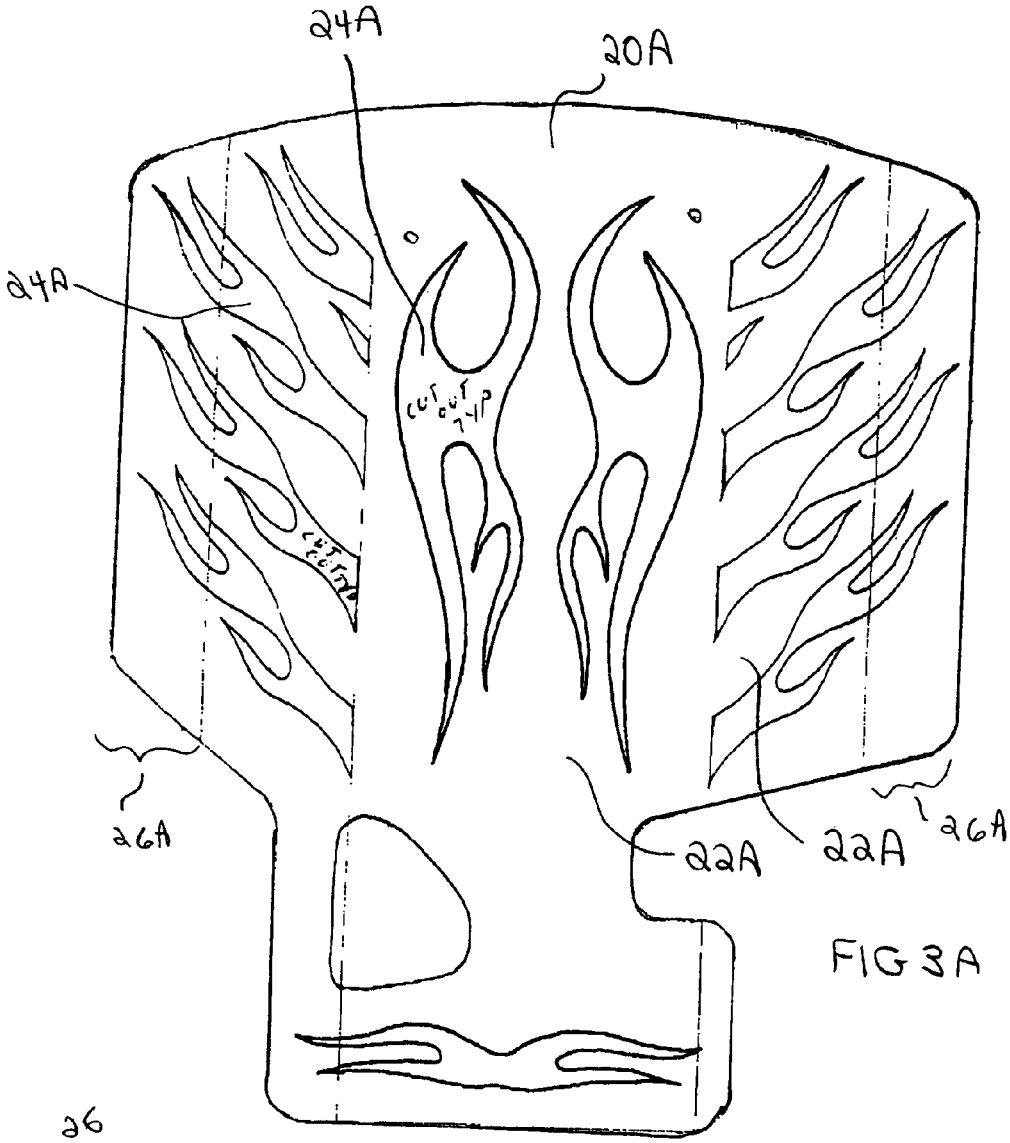
FIG. 3A is a top plan view of a first embodiment of the present invention.
Figure 3B:
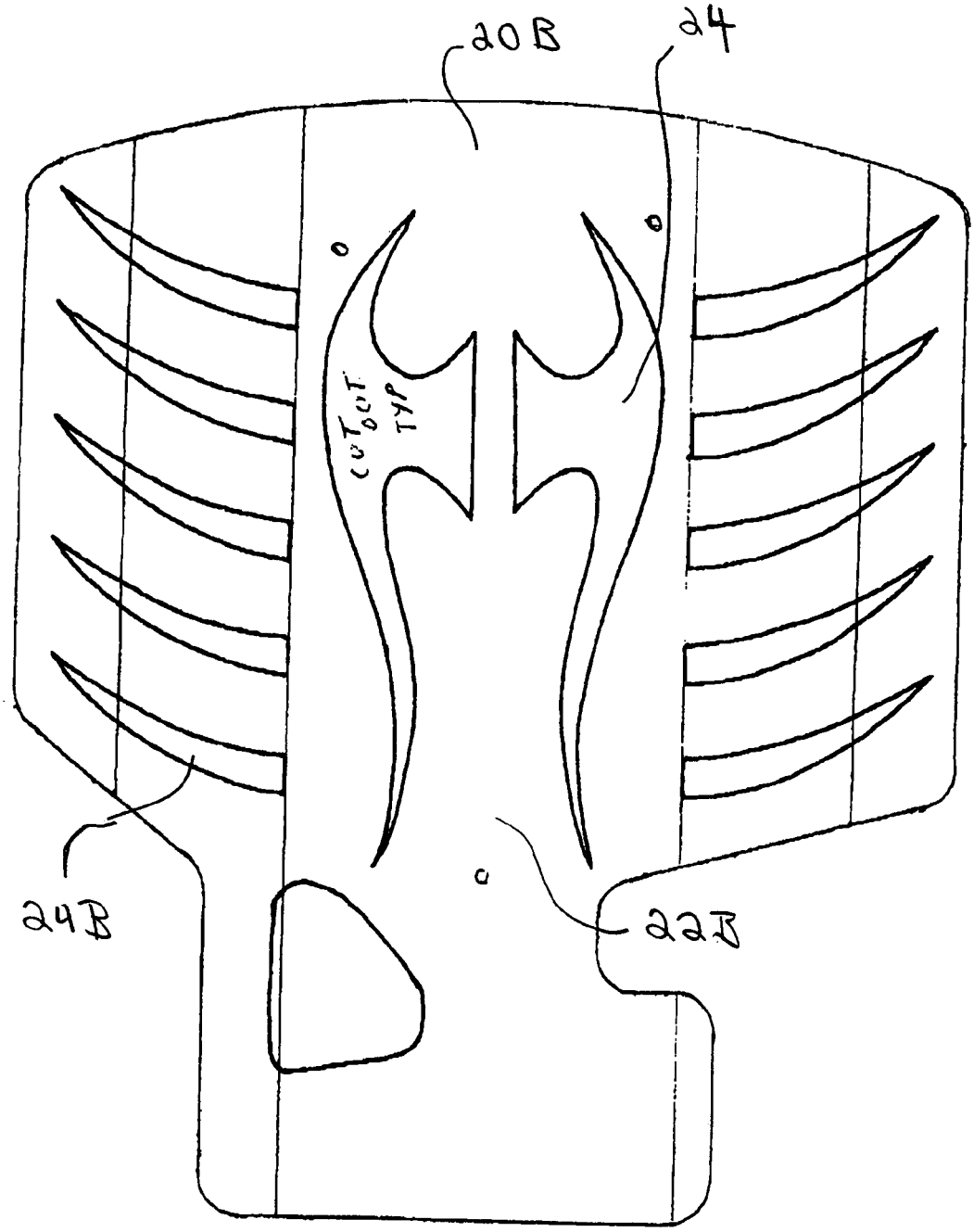
FIG. 3B is a top plan view of a second embodiment of the present invention.
Figure 3C:
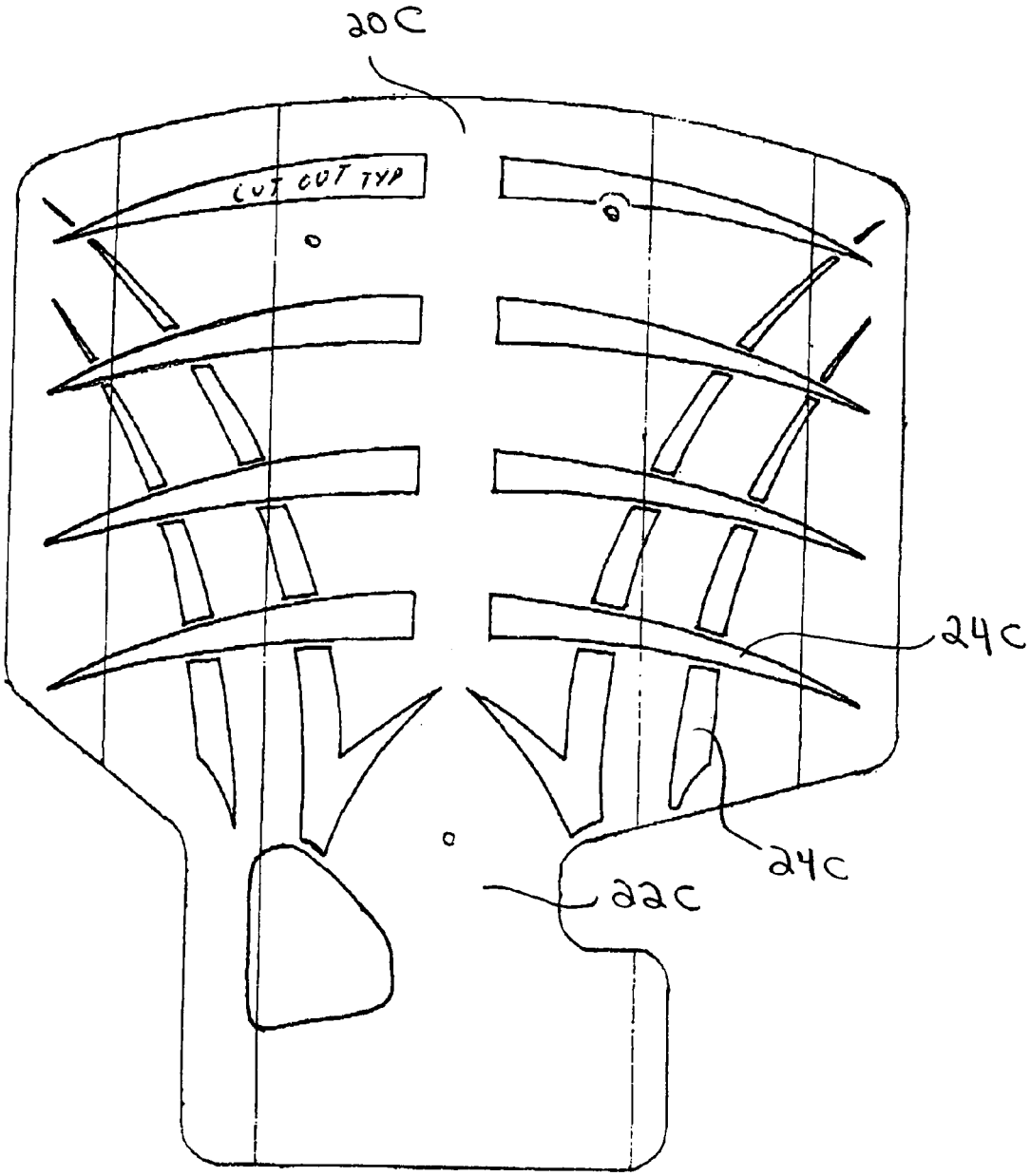
FIG. 3C is a top plan view of a third embodiment of the present invention.
Figure 3D:
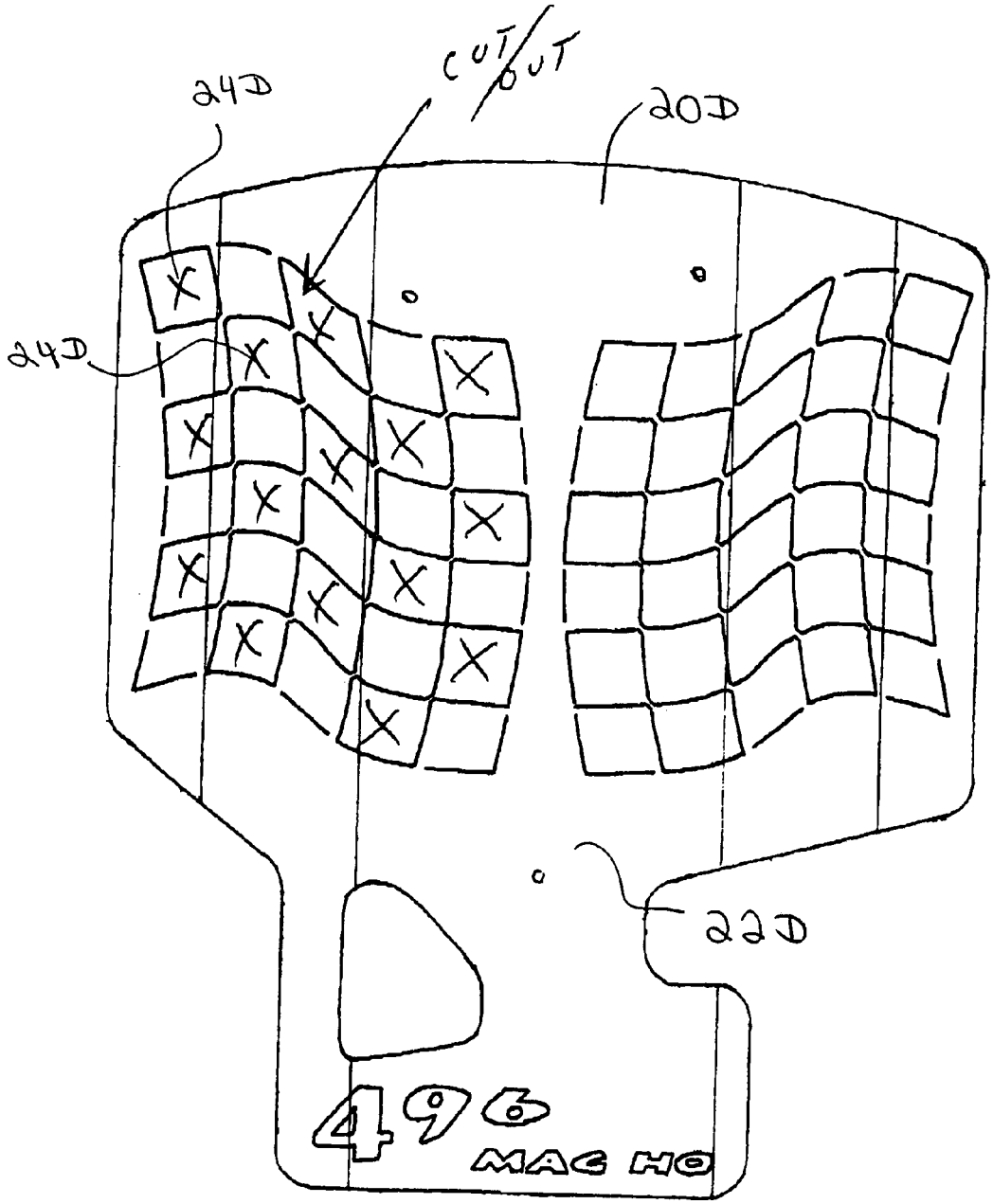
FIG. 3D is a top plan view of a fourth embodiment of the present invention.

Specifically, FIG. 3A shows a motorboat engine cover 20A formed from a metal panel 22A having a plurality of air passages 24A cut therethrough. Similarly, FIG. 3B shows a motorboat engine cover 20B formed from a metal panel 22B having a plurality of air passages 24B cut therethrough. Similarly, FIG. 3C shows a motorboat engine cover 20C formed from a metal panel 22C having a plurality of air passages 24C cut therethrough. Similarly, FIG. 3D shows a motorboat engine cover 20D formed from a metal panel 22D having a plurality of air passages 24D cut therethrough. Metal panel 22 may be made of aluminum and/or stainless steel, but is not so limited. For example, other heat dissipating materials can be used as well.

As can be appreciated, numerous design patterns for air passages 24 can be cut through metal panel 22. Thus, the present invention is not limited to the embodiments of the invention as illustrated herein. In preferred embodiments, air passages 24 comprise from 20% to 40% of the total area of metal panel 22 (i.e.: the "total area" of the metal panel in the absence of air passages 24). Stated another way, 20% to 40% of metal panel 22 is removed by cutting out air passages 24. As can be seen, the removal of 20% to 40% of metal panel 22 by cutting out air passages 24 makes it possible to have large artistic designs formed in metal panel 22 by cutting out air passages 24.

For example, in FIG. 3A, air passages 24A are cut out in the shape of flames. In FIG. 3B, air passages 24B are cut out in the shape of "ribs" with an added center design. In FIG. 3C, air passages 24C are cut out in the shape of a series of interlocking curved ribs. In FIG. 3D, air passages 24D are cut out in the shape of a checkered flag.

In various systems of manufacturing, air passages 24 may be cut through the metal panel 22 by water jet cutting or by laser cutting. It is to be understood that other cutting systems may be used as well.

Figure 4:
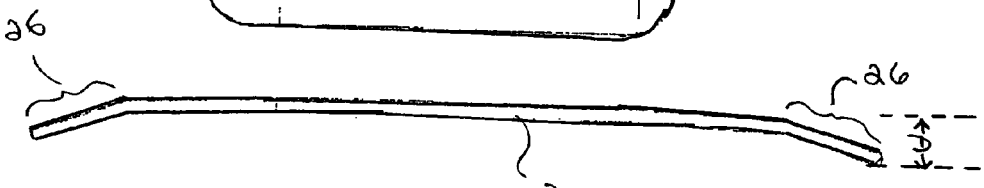
FIG. 4 is a front elevation view of the various embodiments of the present invention.

As shown in FIG. 4, engine cover 20 is substantially planar, but with opposite side edges 26 optionally angled slightly downwards. In optional embodiments, the vertical distance D between the top of the metal panel 22 and the bottom of the downwardly bent edges 26 is from 1.5 to 1.75 inches. As can be seen, metal panel 22 is formed such that no air pockets are formed on its underside. In preferred embodiments, metal panel 22 has a thickness from 0.078 to 0.250 inches, but is not so limited.

Figure 5:
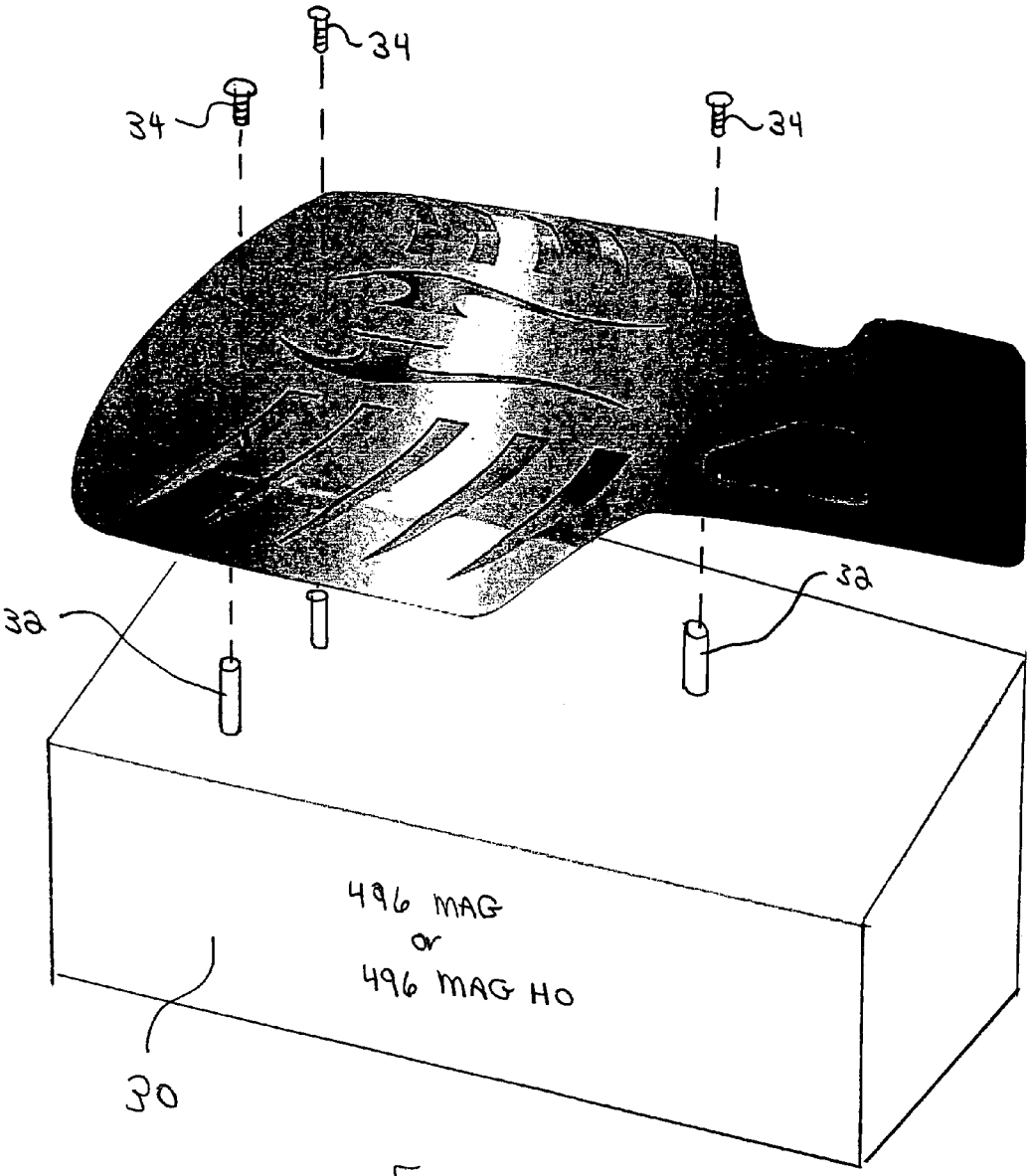
FIG. 5 is an exploded perspective view of the embodiment of the invention shown in FIG. 3B mounted onto a Mercury™ 496 MAG/MAG HO engine.

As shown in FIG. 5, metal panel 20 is connected on top of motorboat engine 30 by three (or more) metal spacers 32 which are preferably held in position by bolts 34. In accordance with the present invention, metal spacers 32 are configured to position metal panel 20 between 2.0 to 2.5 inches above motorboat engine 30. Metal spacers 32 are preferably dimensioned small enough such that they do not interfere with air flow between motorboat engine cover 20 and motorboat engine 30. Metal panel 20 is thus configured to be mounted horizontally above motorboat engine 30 such that substantially unrestricted airflow occurs between metal panel 22 and motorboat engine 30.

In addition, to assist in heat conduction from motorboat engine 30 to engine cover 20, spacers 32 may optionally be made of a metal such as aluminum and/or stainless steel. Engine 30 is illustrated only schematically. In preferred embodiments, motorboat engine 30 may be a Mercury™ 496 MAG/MAG HO motorboat engine, but is not so limited.

What is claimed is:

1. A motorboat engine cover, comprising:

a generally flat metal panel having a plurality of air passages cut therethrough, wherein the air passages comprise from 20 to 40 percent of the total area of the metal panel and wherein the air passages are formed such that the panel has no air pockets on its underside, and wherein the metal panel has a thickness from 0.078 to 0.250 inches, and wherein the metal panel is configured to be mounted horizontally above a motorboat engine such that substantially unrestricted airflow occurs between the metal panel and the motorboat engine.

2. The motorboat engine cover of claim 1, wherein the plurality of air passages are cut in a repeating pattern along the length of the metal panel.

3. The motorboat engine of claim 2, wherein the repeating pattern of air passages is an artistic design.

4. The motorboat engine cover of claim 1, wherein the metal is aluminum.

5. The motorboat engine cover of claim 1, wherein the metal is stainless steel.

6. The motorboat engine cover of claim 1, wherein the plurality of air passages are disposed symmetrically about a center line extending longitudinally through the metal panel.

7. The motorboat engine cover of claim 1, wherein opposite side edges of the metal panel are bent downwardly.

8. The motorboat engine cover of claim 7, wherein the vertical distance between the top of the metal panel and the bottom of the downwardly bent edges is from 1.5 to 1.75 inches.

9. The motorboat engine cover of claim 1, wherein the motorboat engine cover is dimensioned to cover a Mercury™ 496 MAG/MAG HO motorboat engine.

10. A motorboat engine cover, comprising:

a metal panel having a plurality of air passages cut therethrough, wherein the air passages are formed such that the panel has no air pockets on its underside, and wherein the metal panel has a thickness from 0.078 to 0.250 inches, and wherein the metal panel is configured to be mounted horizontally above a motorboat engine such that substantially unrestricted airflow occurs between the metal panel and the motorboat engine, and three metal spacers configured to connect the motorboat engine cover to the motorboat engine.

11. The motorboat engine cover of claim 10, wherein the metal spacers are configured to position the motorboat engine cover between 2.0 to 2.5 inches above the motorboat engine.

12. The motorboat engine cover of claim 10, wherein the metal spacers are made of aluminum.

13. The motorboat engine cover of claim 10, wherein the metal spacers are made of stainless steel.

14. The motorboat engine cover of claim 10, wherein the metal spacers are dimensioned small enough such that they do not interfere with air flow between the motorboat engine cover and the motorboat engine.

15. The motorboat engine cover of claim 1, wherein the air passages are cut through the metal panel by water jet cutting.

16. The motorboat engine cover of claim 1, wherein the air passages are cut through the metal panel by laser cutting.

17. The motorboat engine cover of claim 1, wherein the generally flat metal panel is configured to conduct heat away and dissipate heat from a motorboat engine.

18. The motorboat engine cover of claim 10, wherein generally flat metal panel and the three metal spacers are configured to conduct heat away and dissipate heat from a motorboat engine.

* * * * *